United States Patent [19]

Anderson

[11] Patent Number: 4,796,382

[45] Date of Patent: Jan. 10, 1989

[54] CHRISTMAS TREE HOLDER

[76] Inventor: William E. Anderson, 4211 174th SE., Bothell, Wash. 98036

[21] Appl. No.: 470,389

[22] Filed: Feb. 28, 1983

[51] Int. Cl.[4] ..... A47G 7/02

[52] U.S. Cl. ..... 47/40.5; 248/526

[58] Field of Search ..... 47/40.5; 248/524, 525, 248/526

[56] References Cited

U.S. PATENT DOCUMENTS

| | | | |
|---|---|---|---|
| 2,028,129 | 1/1936 | Allerton | 47/40.5 |
| 2,277,803 | 3/1942 | Varner | 248/524 |
| 2,416,435 | 2/1947 | Carlberg | 248/526 |
| 2,650,783 | 9/1953 | Stanley | 248/525 |
| 2,761,641 | 9/1956 | Lubbers | 47/40.5 |

FOREIGN PATENT DOCUMENTS

| | | | |
|---|---|---|---|
| 932432 | 7/1963 | United Kingdom | 47/40.5 |

*Primary Examiner*—Robert A. Hafer

*Assistant Examiner*—Danton D. DeMille

*Attorney, Agent, or Firm*—Mark Zovko

[57] ABSTRACT

A holder for Christmas trees which includes a container supported above ground level, legs to support the weight of the tree attached to the container, and holding members extending from the legs. The container is provided with a sharpened point or spike upon which the tree base rests, and can hold a reservoir of water. The legs are mounted to the container so that as the weight of the tree depresses the container, the legs spread on the floor and the holding members are forced to engage the tree trunk and hold it in place. Springs are provided at the point at which the legs are attached to the container so that the container may set above ground level at rest position with the holding members spread wide enough to accommodate various tree trunk sizes. Stabilizing pads are provided on the base of the legs at the contact with the floor surface.

2 Claims, 1 Drawing Sheet

CHRISTMAS TREE HOLDER

BACKGROUND OF THE INVENTION

1. Field of the Invention

This invention relates to stands for supporting a tree, and more specifically to a Christmas tree holder which can accommodate a wide range of Christmas tree sizes.

2. Description of the Prior Art

Various types of Christmas tree stands or holders have been provided in the prior art. A typical stand which one may see includes screws to hold the base of the tree in place and an annular ring which supports these screws. Several disadvantages of this design are apparent. For example, the mounting and dismounting operations of these prior art stands are relatively time consuming and difficult. Many times two persons are needed to mount the tree suitably, and even then, stability and alignment problems can occur, especially with heavier trees. Occasionally the fastening means may work loose from the tree trunk. Also, the prior art designs which obviate the above problems are relatively complicated and expensive to produce. The present invention, therefore, recognizes the need for a new improved tree holder which eliminates the above shortcomings.

SUMMARY OF THE INVENTION

The Christmas tree holder of the present invention consists of a container for holding the tree and a reservoir of water. This container is mounted to three or more legs which support the weight of the Christmas tree in operational position. In rest position, the container is held slightly above the floor level. The legs of the stand are attached to the container, preferably by pin and brackets located an equal distance apart on the outer rim of the container. The legs are triangular in an elevation view in the preferred embodiment of the invention.

Extending from the upper part of each leg is a holding member. The holding members are such that at rest a Christmas tree trunk may fit through them. To place the stand in service, the tree trunk is placed within the holding members and allowed to contact the bottom of the container. The container bottom can have impaling means such as a spike or sharpened point which will engage the base of the tree trunk. The weight of the tree will push the container toward floor level and cause the legs of the holder to spread thereby forcing the holding members to grip the tree trunk tightly and hold the tree in a stable position.

Accordingly, it is the object of the present invention to provide a new and improved tree holder which is relatively simple and inexpensive in design and construction and incorporates few moving parts.

Another object of the present invention is to provide a tree holder which enables rapid mounting and dismounting of the tree onto the stand without the need for special screws or nails.

A further object of the present invention is to provide a tree holder which may accommodate a variety of tree trunk sizes without making modifications to parts of the holder.

Still another object of the present invention is to provide a stable Christmas tree holder which can accommodate a variety of tree sizes.

These and other objects and advantages of the present invention will become apparent from the following detailed description when taken in conjunction with the drawings provided.

DESCRIPTION OF THE PREFERRED EMBODIMENT

Figure 1:
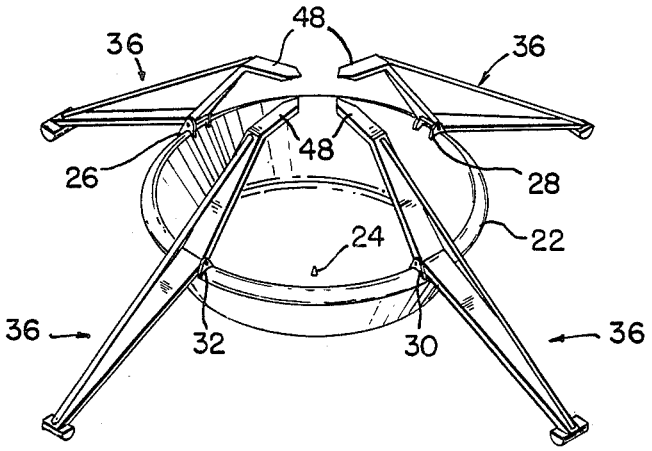
FIG. 1 is a perspective view of a tree standing incorporating the invention.
Figure 2:
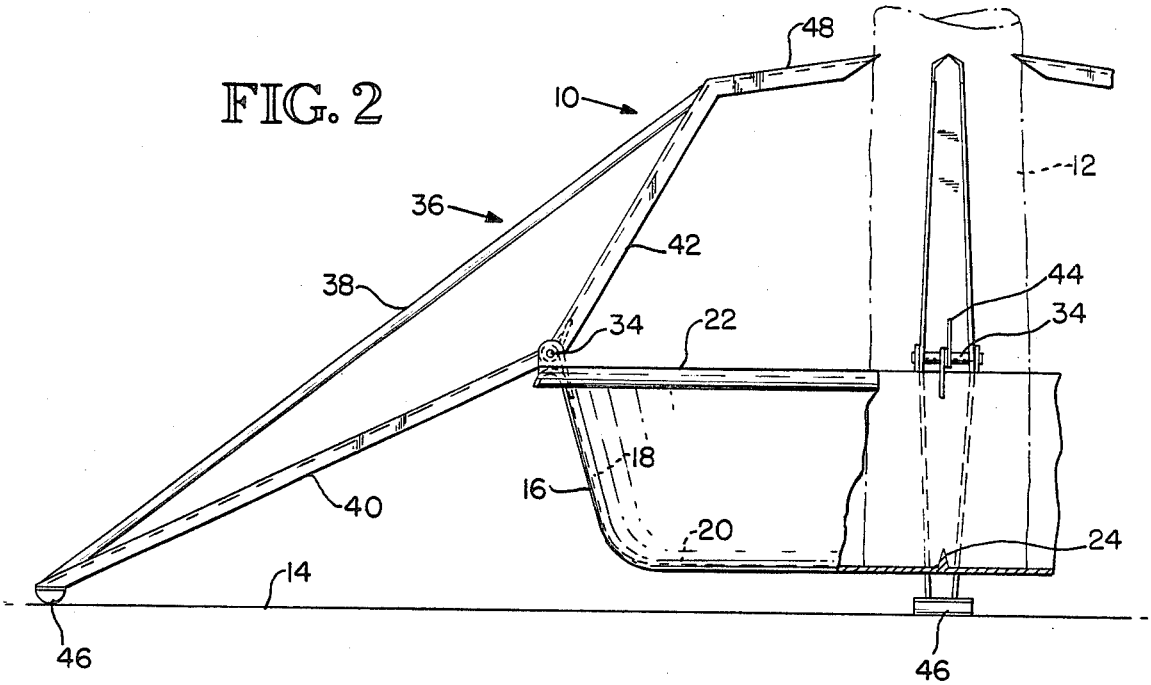
FIG. 2 is an elevational view of a tree stand incorporating the present invention.

Referring to FIGS. 1 and 2, a tree stand generally designated as 10 is shown for supporting a tree 12, such as a Christmas tree or the like in an upright position upon a floor surface 14. The tree stand includes a container generally designated as 16. Container 16 is generally bowl shaped having a wall 18 and base 20. The container 16 also has an outer rim 22 which is shown best in FIG. 1. The container 16 is upwardly open to allow a reservoir of water (not shown) to be contained therein. Impaling means is provided in container 16 on base 20 for impaling the bottom of the trunk of tree 12. The impaling means consists of a centering pin or sharpened point 24 embedded in base 20 of the container 16 at a centrally located position and extending upward along the longitudinal axis of the trunk of tree 12.

Around the outer rim 22 of container 16 are located brackets 26, 28, 30 and 32. The brackets are fixedly attached to the outer rim 22, preferably forming an integral part with the rim. Each bracket is adapted to receive a pin 34 or other fastening means. The midpoints of the brackets are spaced equidistant around the circumference of the outer rim. Each bracket is adapted to hold a support leg, generally designated as 36, having three support members. The three support members consist of a long member 38, a middle-size member 40 and a short member 42. The support members form a triangular shape as shown in the elevation view of FIG. 2 with the apex of members 40 and 42 being attached to a bracket. The attachment is accomplished for each leg 36 by pin 34 fitting through holes in the members which correspond to the holes in the brackets. At this point of attachment, spring means 44 is located. Spring means 44 is wound around each pin 34 and rests against support member 42 and the wall 18 of the container 16, thereby preventing the legs 36 from spreading due to the weight of container 16 in the rest position prior to insertion of tree 12. The apex of support members 38 and 40 has a support pad 46 fixedly attached thereto, which rests on the floor 14. Support pad 46 is preferably of a semi-circular shape in cross section as shown in FIG. 2. At the apex of support member 38 and support member 42 is fixedly attached a holding member 48. The holding member 48 forms a slight angle with the horizontal and is inwardly directed toward the center of the assembly. Prior to insertion of tree 12, the holding members of the legs of the assembly are spaced wide enough apart so as to permit the trunk of a tree to be inserted therein. The leading edge of holding member 48 is preferably pointed or alternatively may be serrated or otherwise shaped to provide a firmer grip upon the trunk of tree 12 when it is inserted in the assembly.

It should be noted that although the drawings show the Christmas tree holder to have four brackets and four legs, the tree holder may also have three brackets and three legs spaced equidistant around the outer rim of the container and still be workable. Also, although it is not shown in the drawings, support member 38 of leg 36 may be bolted to support members 40 and 42. Allowing support member 38 to be detachable from support members 40 and 42 may be desirable from a manufacturing standpoint.

In operation, a sawed-off tree trunk is first prepared for mounting by driving a sharp object such as a nail into the center of the trunk base, and then removing the nail to provide an opening for receiving sharpened point 24. The stand 10 is then placed in an upright position with the legs 36 resting on the floor 14 and the container 16 supported above the floor. The tree is then lowered into stand 10 through the opening between holding members 48 with the tree being guided to center upon the sharpened point 24. Alternatively, the tree may be lowered through holding members 48 until the trunk touches sharpened point 24. A blow of a hammer or other tool on the base 20 would then directly impale the tree trunk. The full weight of the tree 12 is now allowed to react on the base 20 of the container. This reaction will cause the container 16 to lower, thereby spreading legs 36 and causing holding members 48 to secure engagement with the trunk of the tree 12. The tree is held fast in a stable upright position. For dismounting the tree, the tree may be raised to relieve the weight on container 16, thereby causing holding members to cease holding the trunk. The tree may then be pulled from the sharpened point 24.

From the above description, it can be seen that the present invention provides a new and improved tree holder having advantages over existing designs. The stand is comprised of a relatively few inexpensive elements, and may readily mount a Christmas tree without the need for nails or screws as other designs require. The tree stand provides a stable support for the tree and one size of stand may accommodate a wide range of tree sizes.

The invention may be embodied in other forms without departing from the spirit or essential characteristics thereof. The present embodiments are therefore to be considered in all repects as illustrative and not restrictive, scope of the invention being indicated by the appended claims rather than by the foregoing description, and all changes which come within the meaning and range of equivalency of the claims for therefore intended to be embraced therein.

What I claim is:

1. A tree holder comprising:

a. a container having a bottom and an outer rim, the diameter of said container being greater than the depth of said container;

b. impaling means disposed in the bottom of said container for engaging a tree placed in said container;

c. at least three brackets attached to the outer rim of said container, said brackets spaced an equal distance apart on the rim, each bracket adapted to receive a pin;

d. at least three legs with each leg comprised of three support members of unequal length in triangular shape with the apex of the longest and middle size support members resting on the ground, and a holding member extending from the apex of the shortest and longest support member, the distance between the ends of opposing holding members initially being greater than the diameter of the tree trunk to be placed therethrough, said legs supporting said container above the floor by being pinned to said brackets at the apex of the shortest and middle size support members by pins so as to allow rotation of said legs about a longitudinal axis running through the pins whereby the weight of a tree placed through said holding members and into the container engaging said impaling means depresses the container and causes the holding members to contact and support the tree; and e. spring means wound around each pin and abutting against the inside of said container and the shortest support member to maintain the container in a position above ground level prior to insertion of a tree therein.

2. The tree holder of claim 1 wherein the holder includes four brackets and four legs.

* * * * *